US005558238A

United States Patent [19]

Daugherty, Jr.

[11] Patent Number: 5,558,238

[45] Date of Patent: Sep. 24, 1996

[54] FREIGHT RAILWAY CAR SLACKLESS DRAWBAR ASSEMBLY

[75] Inventor: David W. Daugherty, Jr., Plainfield, Ill.

[73] Assignee: Westinghouse Air Brake Company, Wilmerding, Pa.

[21] Appl. No.: 526,436

[22] Filed: Sep. 11, 1995

[51] Int. Cl.[6] ..... B61G 7/00

[52] U.S. Cl. ..... 213/50.5; 213/50; 213/61; 213/62 R; 213/66

[58] Field of Search ..... 213/75 R, 50, 213/50.5, 61, 62 R, 62 A, 63, 69, 66, 71, 72, 74, 51, 67 R, 73; 105/3

[56] References Cited

U.S. PATENT DOCUMENTS

| | | | |
|---|---|---|---|
| 1,557,060 | 10/1925 | Kadel . | |
| 2,240,363 | 4/1941 | Barrows et al. | 213/71 |
| 2,241,353 | 5/1941 | Kinne et al. . | |
| 4,531,648 | 7/1985 | Paton . | |
| 4,555,033 | 11/1985 | Miller . | |
| 4,580,686 | 4/1986 | Elliott . | |
| 4,700,853 | 10/1987 | Altherr et al. . | |
| 4,846,358 | 7/1989 | Rhen . | |
| 4,946,052 | 8/1990 | Kaim et al. . | |
| 5,035,338 | 7/1991 | Kaufhold et al. . | |
| 5,277,323 | 1/1994 | Wallace et al. | 213/75 R |
| 5,462,179 | 10/1995 | Daugherty et al. | 105/3 |

*Primary Examiner*—Mark T. Le
*Attorney, Agent, or Firm*—James Ray & Associates

[57] ABSTRACT

A slackless drawbar assembly connecting adjacent ends of a pair of freight cars together. Such assembly includes a first pair of vertically disposable rear draft stop members and a first pair of radially opposed front draft stop members engageable with and securable to respective ones of a pair of side wall portions of a center sill member disposed on a first car. Each of such first pair of rear and front draft stops include a flat and respectively facing surface portion formed thereon. Additionally, each flat surface portion on at least one of such first pair of rear and front draft stops include a taper. There is a drawbar member provided which has a predetermined length. A first aperture is formed through this drawbar adjacent a first end thereof. There is a first ball member provided which has at least a portion thereof disposed in such first aperture. A first race assembly is secured to such drawbar adjacent such first aperture. Such first race assembly has an inner surface thereof surrounding such at least a portion of the first ball. A first pair of shaft members extend outwardly from opposed sides of such first ball. Each of such first pair of shafts includes opposed flat surfaced end portions which are wedge shaped and which engage respective ones of such flat and respectively facing surface portions on each of such pair of rear and front draft stops. Finally, a first securing device is provided which engages with such center sill portion of such first car and a bottom surface of each of such shafts for securing the assembly within such center sill in a vertical direction.

20 Claims, 5 Drawing Sheets

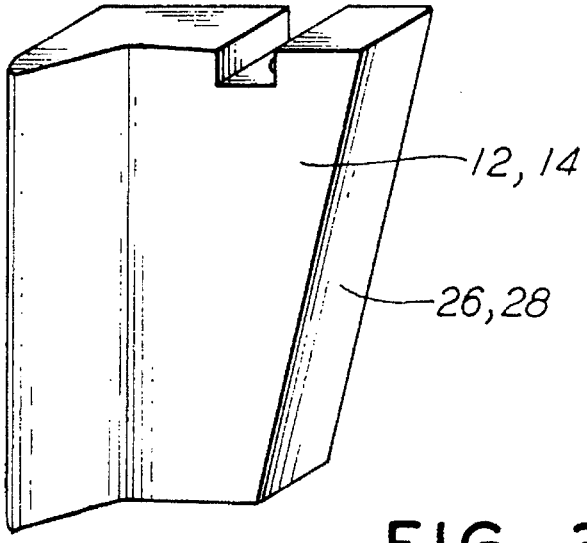
FIG. 3
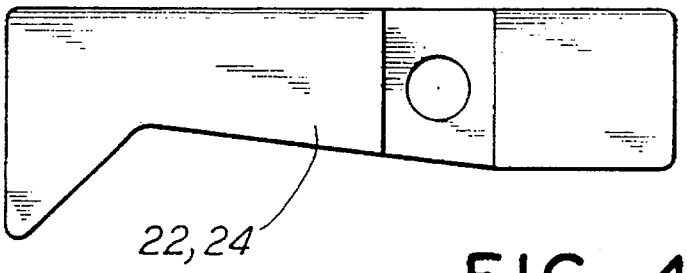
FIG. 4
FIG. 7
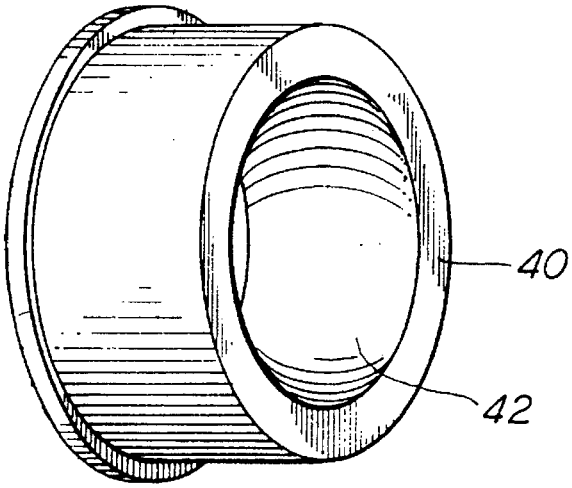

FREIGHT RAILWAY CAR SLACKLESS DRAWBAR ASSEMBLY

CROSS REFERENCE TO RELATED APPLICATION

This application is closely related to my earlier filed and copending application titled, "FREIGHT RAILWAY CAR SLACKLESS DRAWBAR ASSEMBLY" which was filed on Jun. 28, 1995, and bears Ser. No. 08/495,881 and which is assigned to the same assignee as the present invention. The teachings of this copending application are incorporated herein by reference thereto.

FIELD OF THE INVENTION

The present invention relates, in general, to certain selected railway type freight car coupling arrangements of the substantially semipermanent type which are being utilized rather extensively at the present time in the railroad industry to connect the adjacently disposed ends of a pair of such freight cars together in a train consist and, more particularly, the instant invention relates to an improved type of slackless drawbar assembly which will require that only two of the component parts thereof move relative to one another during service in such train consist and that can be utilized to connect such adjacently disposed ends of such pair of such freight cars together in such substantially semipermanent manner and, still more particularly, this invention relates to an improved slackless drawbar assembly which does not require the use of any separate wedge members to maintain the component parts thereof in place within the center sill portion of such railway freight car.

BACKGROUND OF THE INVENTION

As is generally well recognized in the railway freight car coupling art, there are a number of unique designs for slackless type drawbar assemblies that are in rather widespread service in the railroad industry at the present time. Essentially, each one of the several railway freight car coupler manufacturers has its own particular preferred design for a slackless drawbar assembly that it normally supplies to such railroad industry. Nevertheless, each of these different slackless type drawbar assemblies is utilized to connect the adjacently disposed ends of a pair of freight cars together in a substantially semipermanent manner.

In particular, these slackless type drawbar assemblies, which are known by the applicant to be in use at the present time, have generally provided the railroad industry with a more modern and desirable style freight car coupling arrangement. These slackless drawbar assemblies have all but substantially eliminated the need for a relatively expensive draft gear assembly as well as other freight car coupling components that were normally required before the introduction of such slackless type drawbar assemblies.

Furthermore, these slackless drawbar assemblies have generally resulted in a desirable overall net decrease in the empty weight of such railway freight cars. This overall net weight reduction of such freight car is an extremely important factor to be taken into consideration by the user of such railway freight car in view of the ever rising energy cost.

It is believed to be equally well recognized, in the railroad industry, that these slackless drawbar assemblies are primarily installed on a freight car which will be utilized in a dedicated service type of application. Most of the freight cars that are primarily utilized in this dedicated type service normally will not require that they be uncoupled except for routine maintenance and/or possible repair.

By way of example only, such railway freight type cars which generally are used in such dedicated type service will at least include: coal and other mineral transport cars, automobile and light truck transport cars and certain tank cars which carry a variety of chemicals.

Each of such slackless drawbar assemblies which are known to be in use at the present time, however, suffer from at least one important and common disadvantage. This common disadvantage is that these slackless drawbar assemblies all require a significant number of component parts.

Additionally, many of these component parts include a number of certain selected surfaces thereof that are frictionally engaged and are subjected to extremely high loads during in-track service. Furthermore, such frictionally engaged surfaces are periodically required to move relative to one another while under such extremely high loads.

It should be obvious, particularly to persons who are skilled in the relevant mechanical arts, that such relative movement between these frictionally engaged surfaces, particularly when they are in a loaded condition, will quite often result in not only the generation of considerable heat, but also substantial wear of these component parts thereby resulting in relatively frequent and rather costly maintenance having to be carried out. In some of the more severe cases, these freight cars must even be removed from a revenue generating type service for relatively long periods of time.

These slackless type drawbar assemblies have, nevertheless, gained a rather widespread acceptance in the railroad industry over the past several years in spite of the number of disadvantages which were discussed in some detail above. This would be expected, however, because there are a number of significant advantages that were gained by such railroad industry, over the older style standard type coupling arrangements which were and still are being used. Experience has demonstrated that these advantages far outweigh the disadvantages and such slackless drawbar assemblies have proven to the railroad industry over an extended period of time to be quite cost effective.

SUMMARY OF THE INVENTION

The present invention provides an improved slackless type drawbar assembly for connecting the adjacently disposed ends of a pair of railway type freight cars together in a substantially semipermanent manner. Such slackless drawbar assembly comprises a first pair of vertically disposable rear draft stop members. These rear draft stop members are engageable with and securable to respective ones of a pair of vertically disposed side wall portions of a center sill member that is disposed along the longitudinal centerline of a first railway freight car. There is a first pair of substantially radially opposed and vertically disposable front draft stop members. These front draft stop members are likewise engageable with and securable to such respective ones of such pair of such vertically disposed side wall portions of such center sill member disposed along such longitudinal centerline of such first railway freight car. Each of such first pair of rear draft stop members and such first pair of front draft stop members includes a substantially flat and respectively facing surface portion formed thereon. Additionally, each substantially flat surface portion disposed on at least one of such first pair of rear draft stop members and such first pair of front draft stop members includes a predetermined taper. There is an elongated drawbar member provided which has a predetermined length. A first aperture, having a predetermined configuration, is formed through this elongated drawbar member closely adjacent a first end thereof. There is a first ball member provided which has at least a portion thereof disposed in such first aperture. Such first ball member has a predetermined diameter. A first race assembly is secured to such elongated drawbar member adjacent such first aperture. Such first race assembly has an inner surface thereof surrounding such at least a portion of the first ball member disposed in such first aperture. A first pair of elongated shaft members extend outwardly from radially opposed sides of such first ball member for a predetermined distance. Each of such first pair of shaft members includes substantially radially opposed flat surfaced end portions which are wedge shaped and which engage respective such substantially flat and respectively facing surface portions disposed on each of such pair of rear draft stop members and such pair of front draft stop members. Finally, there is a first securing means provided which is engageable with such center sill portion of such first freight car and a bottom surface of each of such pair of such elongated shaft members for securing the slackless drawbar assembly within such center sill member in a vertical direction.

OBJECTS OF THE INVENTION

It is, therefore, one of the primary objects of the present invention to provide an improved slackless type drawbar assembly for connecting the adjacently disposed ends of a pair of railway freight cars together which requires a minimum number of component parts that must move relative to one another during in-track service.

Another object of the present invention is to provide an improved slackless type drawbar assembly for connecting the adjacently disposed ends of a pair of railway freight cars together which can be easily retrofitted onto an existing railway freight car within the center sill portion of such freight car.

Still another object of the present invention is to provide an improved slackless type drawbar assembly for connecting the adjacently disposed ends of a pair of railway freight cars together which will provide an enhanced service life.

Yet another object of the present invention is to provide an improved slackless type drawbar assembly for connecting the adjacently disposed ends of a pair of railway freight cars together which will require a minimum amount of maintenance.

A further object of the present invention is to provide an improved slackless type drawbar assembly for connecting the adjacently disposed ends of a pair of railway freight cars together which can have incorporated therein a substantially permanent lubricating liner member between the surfaces thereof which move relative to one another.

It is an additional object of the present invention to provide an improved slackless type drawbar assembly for connecting the adjacently disposed ends of a pair of railway freight cars together which is relatively light weight.

Still yet another object of the present invention is to provide an improved slackless type drawbar assembly for connecting the adjacently disposed ends of a pair of railway freight cars together which is relatively simple to install.

Yet still another object of the present invention is to provide an improved slackless type drawbar assembly for connecting the adjacently disposed ends of a pair of railway freight cars together which is cost effective due to enhanced service life and relatively free maintenance requirements, thereby increasing the time such railway freight cars will be in productive revenue generating service.

A still further object of the present invention is to provide an improved slackless type drawbar assembly for connecting the adjacently disposed ends of a pair of railway freight cars together which does not require any specialized equipment to install.

An additional object of the present invention is to provide an improved slackless drawbar assembly for connecting the adjacently disposed ends of a pair of railway freight cars together which can be readily converted back to use of standard type couplers if the need arises.

In addition to the various objects and advantages of the present invention which have been generally described above, there will be various other objects and advantages of the invention that will become more readily apparent to those persons who are skilled in the relevant art from the following more detailed description of such invention, particularly, when such detailed description is taken in conjunction with the attached drawing Figures and with the appended claims.

BRIEF DESCRIPTION OF THE DRAWINGS

FIG. 3 is a perspective view of one presently preferred form of a rear draft stop member for use in the presently preferred embodiment of thee invention;

FIG. 4 is a top plan view of one presently preferred embodiment of a front draft stop member for use in a slackless drawbar assembly constructed according to this invention;

FIG. 7 is a perspective view of the race assembly which holds the presently preferred ball member having a pair of shaft members disposed on radially opposed sides thereof in the end of the drawbar member;

Figure 1:
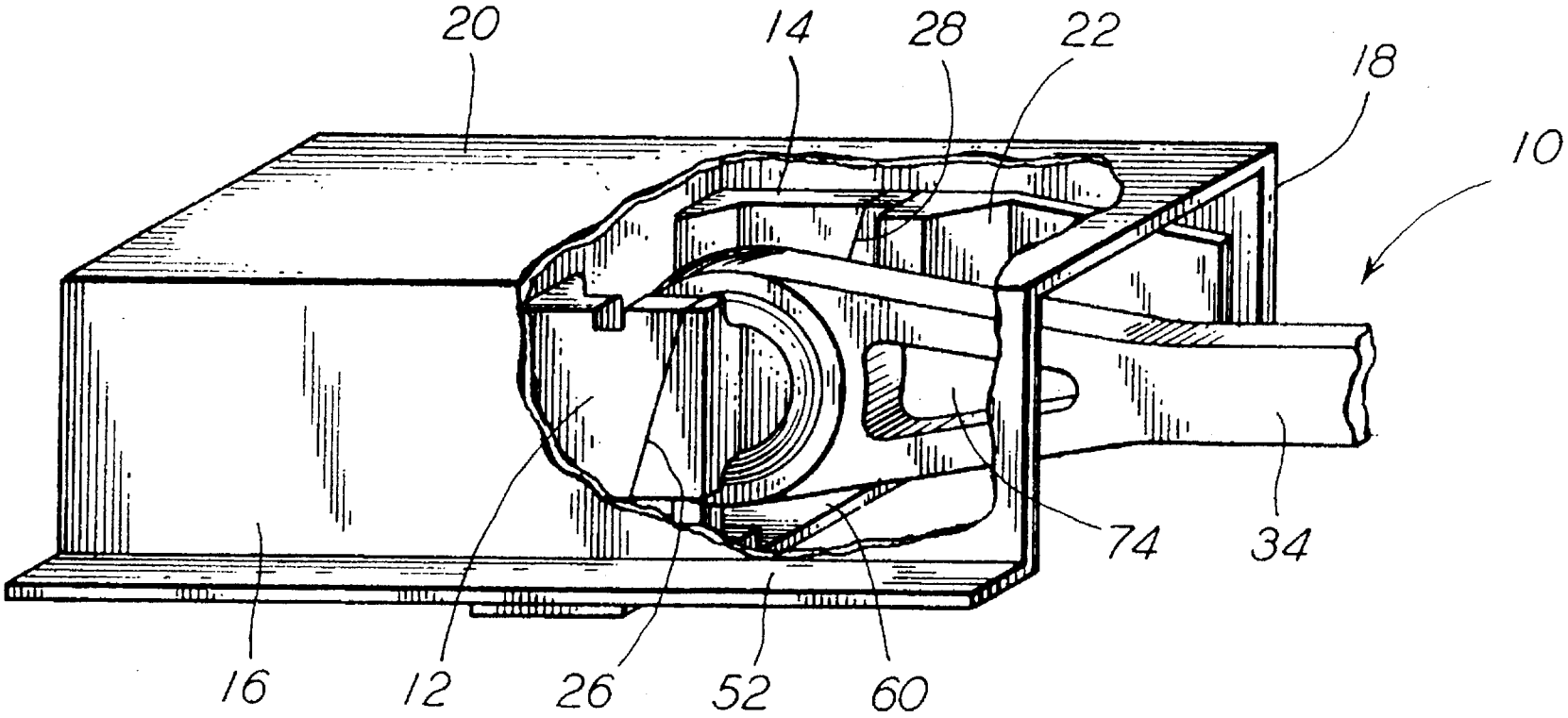
FIG. 1 is a perspective view, with portions cut away, of one presently preferred embodiment of one end of a slackless drawbar assembly constructed according to this invention.
Figure 2:
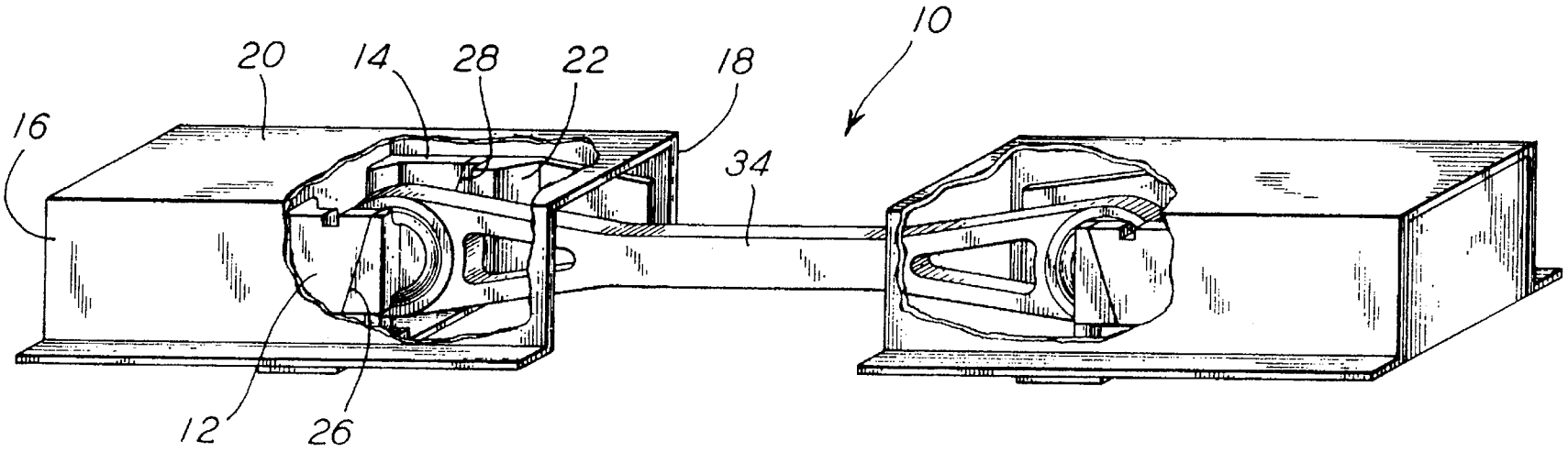
FIG. 2 is a perspective view, with portions cut away, of the slackless drawbar assembly illustrated in FIG. 1 connected into a center sill member at each end thereof.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing Figures, for the sake of clarity and understanding of the invention.

Now reference is made, more particularly, to the several drawing Figures. Illustrated therein is an improved slackless type drawbar assembly, generally designated 10, constructed according to a presently preferred embodiment of the invention. Such drawbar assembly 10 is utilized to connect the adjacently disposed ends (not shown) of a pair of railway freight type cars (not shown) together in a substantially semipermanent manner.

Such slackless drawbar assembly includes a first pair of vertically disposable rear draft stop members 12 and 14. Such rear draft stop members 12 and 14 are adapted to be engageable with and securable to respective ones of a pair of vertically disposed side wall portions 16 and 18 of a center sill member 20 disposed along a longitudinal centerline of a first one of such pair of railway freight cars.

There is a first pair of substantially radially opposed and vertically disposable front draft stop members 22 and 24, as best seen in (FIG. 10), which are adapted to be engageable with and securable to such respective ones of such pair of such vertically disposed side wall portions 16 and 18 of such center sill member 20 disposed along such longitudinal centerline of such first railway freight car.

Each of such first pair of these rear draft stop members 12 and 14 and the first pair of such front draft stop members 22 and 24 has a substantially flat and respectively facing surface portion 26, 28 and 30, 32 respectively, formed thereon.

In addition, each substantially flat and respectively facing surface portion 26, 28, 30 and 32 disposed on at least one of such first pair of rear draft stop members 12 and 14 and such first pair of the front draft stop members 22 and 24 will have a predetermined taper.

According to the presently preferred embodiment of the invention, each of such substantially flat and respectively facing surface portions 26, 28, 30 and 32 disposed on such each one of such at least one of such first pair of such rear draft stop members 12 and 14 and such first pair of such front draft stop members 22 and 24 is tapered downwardly from respective top surfaces thereof and inwardly toward respective bottom surfaces thereof. Additionally, such taper of these substantially flat and respectively facing surface portions 26, 28, 30 and 32 of such each one of the at least one of such first pair of rear draft stop members 12 and 14 and such first pair of front draft stop members 22 and 24 will be between generally about 5.0 degrees and about 15.0 degrees. Furthermore, in the presently preferred embodiment, each one of each of such first pair of rear draft stop members 12 and 14 and such first pair of front draft stop members 22 and 24 will include such substantially flat surface portion.

The presently preferred slackless drawbar assembly includes an elongated drawbar member 34. Such elongated drawbar member 34 will have a predetermined length which is at least sufficient to provide a suitable spacing between the adjacently disposed ends of such pair of railway freight type cars to enable them to negotiate the curves and inclined surfaces which may be encountered on the track structure during normal operation of the train consist of which they are a part.

Figure 5:
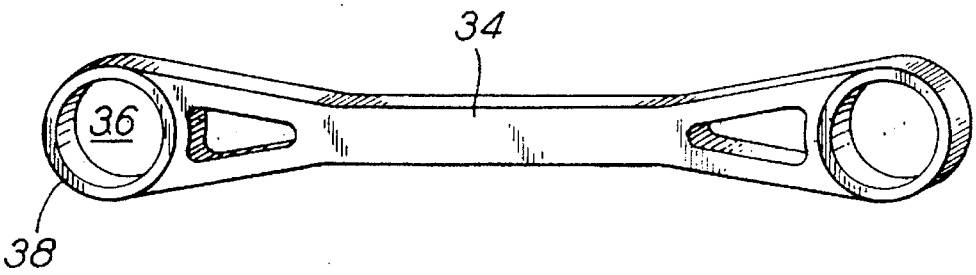
FIG. 5 is a perspective side elevation view which illustrates the elongated drawbar member which carries the ball member portion of the slackless drawbar assembly illustrated in FIGS. 1 and 2.
Figure 8:
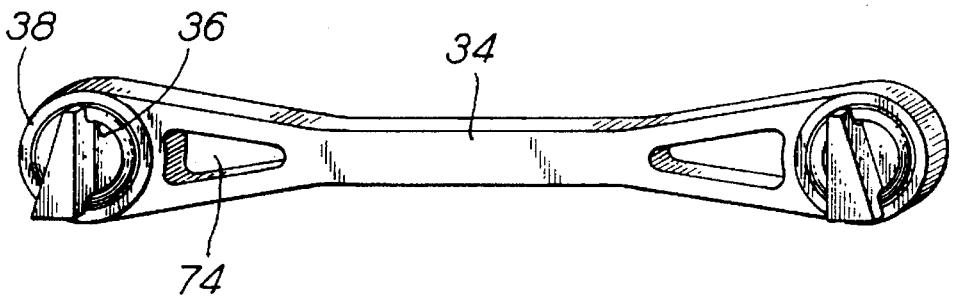
FIG. 8 is a perspective side elevation view of the presently preferred embodiment of the drawbar member having the ball member and the race assembly incorporated therein.

A first aperture 36, as best seen in (FIG. 5), having a predetermined configuration, is formed through the elongated drawbar member 34 closely adjacent a first end 38 thereof. As illustrated in FIG. 5 the presently preferred predetermined configuration of such first aperture 36 will be generally round, although other configurations are feasible.

Figure 6:
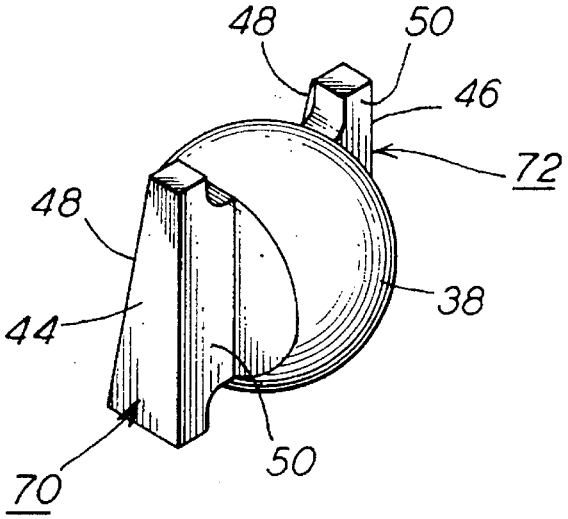
FIG. 6 is a perspective view of the ball member portion of the slackless drawbar assembly illustrated in FIGS. 1 and 2.

Slackless drawbar assembly 10 further includes a first ball member 38, as can best be seen in (FIG. 6), which has at least a portion thereof disposed in such first aperture 36. This first ball member 38 has a predetermined diameter.

A first race assembly 40, best seen in (FIG. 7), is secured to such elongated drawbar member 34 adjacent the first aperture 36. An inner surface 42 of such first race assembly surrounds such at least a portion of the first ball member 38 which is disposed in such first aperture 36. According to the presently preferred embodiment of the invention such first race assembly 40 will be removably secured to such elongated drawbar member 34. Bolts (not shown), for example, may be used to removably secure such first race assembly 40 to such elongated drawbar member 34.

There is a first pair of elongated shaft members 44 and 46 which extend outwardly from the radially opposed sides of such first ball member 38 for a predetermined distance. Each one of these first pair of shaft members 44 and 46 includes substantially radially opposed flat surfaced end portions 48 and 50 which are wedge shaped and which engage respective ones of such substantially flat and respectively facing surface portions 26, 28, 30 and 32 disposed on each of such pair of rear draft stop members 12 and 14 and the pair of such front draft stop members 22 and 24.

In the preferred embodiment of the slackless type drawbar assembly 10, according to the present invention, such predetermined configuration of the first aperture 36 formed through such elongated drawbar member 34 adjacent the first end 38 thereof is generally round and has a predetermined diameter. Preferably, this predetermined diameter of such generally round first aperture 36 formed through such elongated drawbar member 34 adjacent the first end 38 thereof will generally be between about 8.375 inches and about 9.625 inches and preferably in this embodiment of the invention such predetermined diameter of such first ball member 38, having at least a portion thereof disposed in said first aperture 36, will generally be between about 8.5 inches and about 9.5 inches.

Figure 9:
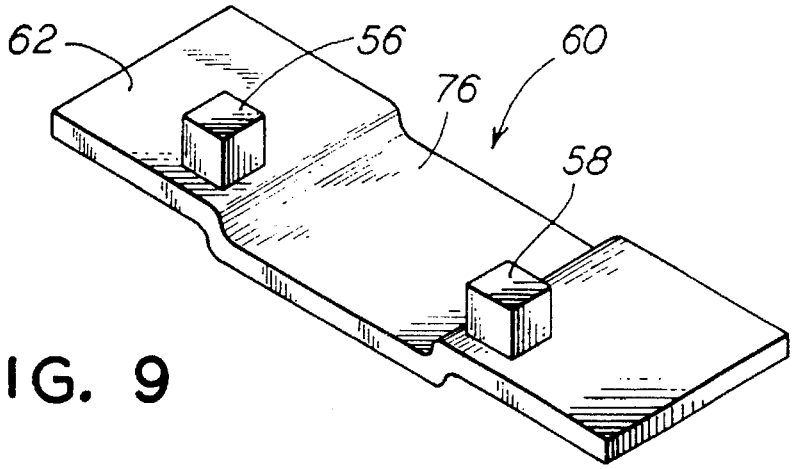
FIG. 9 is perspective view of a presently preferred support member used to hold the slackless drawbar assembly in a vertical direction within the center sill portion of a railway freight car.
Figure 10:
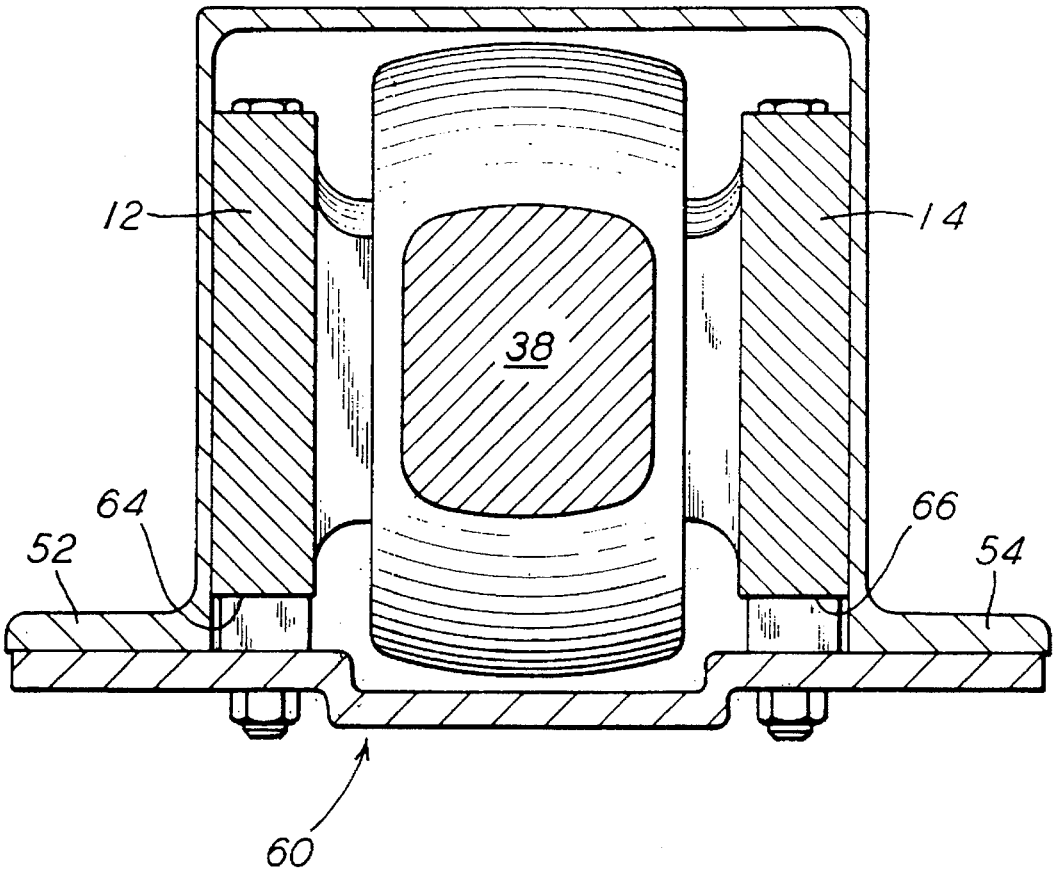
FIG. 10 is an end view of the presently preferred embodiment of the slackless drawbar assembly constructed according to the present invention.

Additionally, the slackless drawbar assembly 10 includes a first securing means, generally designated as 60, which is best seen in (FIGS. 9 and 10). Securing means 60 is engageable with and securable to the flange portions 52 and 54 of such center sill portion 20 of the first freight car. A pair of radially opposed posts 56 and 58 extend upwardly from the top surface 62 of such securing means 60 and engage with a respective bottom surface 64 and 66 of each of such pair of elongated shaft members 44 and 46 for securing such slackless drawbar assembly 10 within such center sill member 20 in a vertical direction.

Such first securing means 60 includes a generally U-shaped portion 76 disposed substantially intermediate each end thereof to enable a required angling of such elongated drawbar member 34. Additionally, such first securing means 60 further includes a pair of posts 56 and 58 extending upwardly from an upper surface thereof.

In the presently preferred slackless type drawbar assembly 10, according to the invention, an outermost face portion 70 of a first one 44 of such first pair of shaft members 44 and 46 is linearly displaced a distance of generally between about 12.5 inches and about 12.75 inches from a radially opposed outermost face portion 72 of a second one 46 of such first pair of shaft members 44 and 46.

It is, also, presently preferred that an outermost end surface of such first end of the elongated drawbar member 34 will be convexly shaped in each of a generally horizontal direction and a generally vertical direction. Further, in this embodiment of the invention, such elongated drawbar member 34 will preferably include at least one weight reducing aperture 74, having a predetermined configuration, formed therethrough intermediate such first aperture 36 and a midpoint of a length of such elongated drawbar member 34. The predetermined configuration of such at least one weight reducing aperture 74 formed through such elongated drawbar member 34 is, preferably, generally triangular in shape.

For the sake of brevity, it should be noted that in the most presently preferred embodiment of the instant invention, the first end of such slackless drawbar assembly 10 described in detail above is substantially a mirror image of the second end of such slackless drawbar assembly 10. Accordingly, a detailed description of the second end of such slackless drawbar assembly 10 will not be repeated here.

While a presently preferred and various additional alternative embodiments of the instant invention have been described in detail above in accordance with the patent statutes, it should be recognized that various other modifications and adaptations of the invention may be made by those persons who are skilled in the relevant art without departing from either the spirit or the scope of the appended claims.

I claim:

1. A slackless type drawbar assembly for connecting adjacently disposed ends of a pair of railway type freight cars together in a substantially semipermanent manner, said slackless drawbar assembly comprising:

(a) a first pair of vertically disposable rear draft stop members engageable with and securable to respective ones of a pair of vertically disposed side wall portions of a center sill member disposed along a longitudinal centerline of a first railway freight car;

(b) a first pair of substantially radially opposed and vertically disposable front draft stop members engageable with and securable to such respective ones of such pair of such vertically disposed side wall portions of such center sill member disposed along such longitudinal centerline of such first railway freight car;

(c) each of said first pair of said rear draft stop members and said first pair of said front draft stop members having a substantially flat and respectively facing surface portion formed thereon;

(d) each said substantially flat surface portion disposed on at least one of said first pair of said rear draft stop members and said first pair of said front draft stop members having a predetermined taper;

(c) an elongated drawbar member having a predetermined length;

(f) a first aperture, having a predetermined configuration, formed through said elongated drawbar member adjacent a first end thereof;

(g) a first ball member having at least a portion thereof disposed in said first aperture, said first ball member having a predetermined diameter;

(h) a first race assembly secured to said elongated drawbar member adjacent said first aperture and having an inner surface thereof surrounding said at least a portion of said first ball member disposed in said first aperture;

(i) a first pair of elongated shaft members extending outwardly from radially opposed sides of said first ball member for a predetermined distance, each of said first pair of shaft members including substantially radially opposed flat surfaced end portions which are wedge shaped and which engage respective said substantially flat and respectively facing surface portions disposed on each of said pair of rear draft stop members and said pair of said front draft stop members; and (j) a first securing means engageable with such center sill portion of such first freight car and a bottom surface of each of said pair of said elongated shaft members for securing said slackless drawbar assembly within such center sill member in a vertical direction.

2. A slackless type drawbar assembly, according to claim 1, wherein each said substantially flat and respectively facing surface portion disposed on said each one of said at least one of said first pair of said rear draft stop members and said first pair of said front draft stop members is tapered downwardly from a respective top surface thereof and inwardly toward respective bottom surface thereof.

3. A slackless type drawbar assembly, according to claim 2, wherein said taper of said substantially flat and respectively facing surface portion of said each one of said at least one of said first pair of said rear draft stop members and said first pair of said front draft stop members is between generally about 5.0 degrees and about 15.0 degrees.

4. A slackless type drawbar assembly, according to claim 3, wherein said each one of each of said first pair of said rear draft stop members and said first pair of said front draft stop members includes said substantially flat surface portion.

5. A slackless type drawbar assembly, according to claim 1, wherein said predetermined configuration of said first aperture formed through said elongated drawbar member adjacent said first end thereof is generally round and has a predetermined diameter.

6. A slackless type drawbar assembly, according to claim 5, wherein said predetermined diameter of said generally round first aperture formed through said elongated drawbar member adjacent said first end thereof is generally between about 8.375 inches and about 9.625 inches.

7. A slackless type drawbar assembly, according to claim 6, wherein said predetermined diameter of said first ball member having at least a portion thereof disposed in said first aperture is generally between about 8.5 inches and about 9.5 inches.

8. A slackless type drawbar assembly, according to claim 1, wherein said first race assembly is removably secured to said elongated drawbar member adjacent said first aperture.

9. A slackless type drawbar assembly, according to claim 1, wherein an outermost face portion of a first one of said first pair of shaft members is linearly displaced a distance of generally between about 12.5 inches and about 12.75 from a radially opposed outermost face portion of a second one of said first pair of shaft members.

10. A slackless type drawbar assembly, according to claim 1, wherein an outermost end surface of said first end of said elongated drawbar member is convexly shaped in each of a generally horizontal direction and a generally vertical direction.

11. A slackless type drawbar assembly, according to claim 10, wherein said elongated drawbar member includes at least one weight reducing aperture, having a predetermined configuration, formed therethrough intermediate said first aperture and a midpoint of a length of said elongated drawbar member.

12. A slackless type drawbar assembly, according to claim 11, wherein said predetermined configuration of said at least one weight reducing aperture formed through said elongated drawbar member is generally triangular in shape.

13. A slackless type drawbar assembly, according to claim 1, wherein said first securing means includes a generally U-shaped portion disposed substantially intermediate each end of said first securing means to enable a required angling of said elongated drawbar member.

14. A slackless type drawbar assembly, according to claim 13, wherein said first securing means further includes a pair of posts extending upwardly from an upper surface thereof.

15. A slackless type drawbar assembly for connecting adjacently disposed ends of a pair of railway type freight cars together in a substantially semipermanent manner, said slackless drawbar assembly comprising:

(a) a first pair of vertically disposable rear draft stop members engageable with and securable to respective ones of a pair of vertically disposed side wall portions of a center sill member disposed along a longitudinal centerline of a first railway freight car;

(b) a first pair of substantially radially opposed and vertically disposable front draft stop members engageable with and securable to such respective ones of such pair of such vertically disposed side wall portions of such center sill member disposed along such longitudinal centerline of such first railway freight car;

(c) each of said first pair of said rear draft stop members and said first pair of said front draft stop members having a substantially flat and respectively facing surface portion formed thereon;

(d) each said substantially flat surface portion disposed on at least one of said first pair of said rear draft stop members and said first pair of said front draft stop members having a predetermined taper;

(e) an elongated drawbar member having a predetermined length;

(f) a first aperture, having a predetermined configuration, formed through said elongated drawbar member adjacent a first end thereof;

(g) a first ball member having at least a portion thereof disposed in said first aperture, said first ball member having a predetermined diameter;

(h) a first race assembly secured to said elongated drawbar member adjacent said first aperture and having an inner surface thereof surrounding said at least a portion of said first ball member disposed in said first aperture;

(i) a first pair of elongated shaft members extending outwardly from radially opposed sides of said first ball member for a predetermined distance, each of said first pair of shaft members including substantially radially opposed flat surface portions which are wedge shaped and which engage respective said substantially flat and respectively facing surfaced end portions disposed on each of said pair of rear draft stop members and said pair of said front draft stop members;

(j) a first securing means engageable with such center sill portion of such first freight car and a bottom surface of each of said pair of said elongated shaft members for securing said slackless drawbar assembly within such center sill member in a vertical direction;

(k) a second pair of vertically disposable rear draft stop members engageable with and securable to said respective ones of such pair of vertically disposed side wall portions of such center sill member disposed along a longitudinal centerline of an adjacently disposed second railway freight car;

(l) a second pair of substantially radially opposed and vertically disposable front draft stop members engageable with and securable to such respective ones of such pair of vertically disposed side wall portions of such center sill member disposed along such longitudinal centerline of such second railway freight car;

(m) each of said second pair of rear draft stop members and said second pair of front draft stop members having a substantially flat and respectively facing surface portion;

(n) a second aperture, having a predetermined configuration, formed through said elongated drawbar member adjacent a second end thereof;

(o) a second ball member having at least a portion thereof disposed in said second aperture, said second ball member having a predetermined diameter;

(p) a second race assembly secured to said elongated drawbar member adjacent said second aperture and having an inner surface thereof surrounding said at least a portion of said second ball member disposed in said second aperture;

(q) a second pair of elongated shaft members extending outwardly from radially opposed sides of said second ball member for a predetermined distance, each of said second pair of shaft members including substantially radially opposed flat surface portions which are wedge shaped and which engage respective said substantially flat and respectively facing surfaced end portions disposed on each of said pair of rear draft stop members and said pair of said front draft stop members; and (r) a second securing means engageable with such center sill portion of such second freight car and a bottom surface of each of said second pair of said elongated shaft members for securing said slackless drawbar assembly within such center sill member in a vertical direction.

16. A slackless type drawbar assembly, according to claim 15, wherein said slackless drawbar assembly further includes an annular space disposed between respective outer surfaces of said first and said second ball members and said inner surface of said first and said second race assemblies and a substantially solid lubricating liner member disposed in said annular space.

17. A slackless type drawbar assembly, according to claim 15, wherein said elongated drawbar assembly includes a pair of weight reducing apertures formed therethrough.

18. A slackless type drawbar assembly, according to claim 15, wherein said first ball member and said first pair of shaft members are formed as a first single piece unit and said second ball member and said second pair of shaft members are formed as a second single piece unit.

19. A slackless type drawbar assembly, according to claim 18, wherein each of said first single piece unit and said second single piece unit is a forging.

20. A slackless type drawbar assembly, according to claim 15, wherein said first end of said slackless drawbar assembly is substantially a mirror image of said second end of said slackless drawbar assembly.

* * * * *

UNITED STATES PATENT AND TRADEMARK OFFICE

CERTIFICATE OF CORRECTION

PATENT NO. : 5,558,238

DATED : September 24, 1996

INVENTOR(S) : David W. Daugherty, Jr.

It is certified that error appears in the above-identified patent and that said Letters Patent is hereby corrected as shown below:

Column 5, line 30, after "32", please insert --,--.

Signed and Sealed this

FourthDay of August, 1998

Bruce Lehman

*Attest:*

BRUCE LEHMAN

*Attesting Officer*

*Commissioner of Patents and Trademarks*